US006283301B1

(12) United States Patent
Pedersen

(10) Patent No.: US 6,283,301 B1
(45) Date of Patent: Sep. 4, 2001

(54) SEPARATION DEVICE AND METHOD OF USE

(75) Inventor: Leo Pedersen, Danville, CA (US)

(73) Assignee: Dantec Engineering, Inc., Danville, CA (US)

( * ) Notice: Subject to any disclaimer, the term of this patent is extended or adjusted under 35 U.S.C. 154(b) by 0 days.

(21) Appl. No.: 09/454,809

(22) Filed: Dec. 3, 1999

(51) Int. Cl.[7] ..... B07B 4/00; B07B 7/00

(52) U.S. Cl. ..... 209/139.1; 209/138; 209/142; 209/143

(58) Field of Search ..... 209/138, 139.1, 209/142, 143

(56) References Cited

U.S. PATENT DOCUMENTS

| | | | | |
|---|---|---|---|---|
| 32,679 | | 7/1861 | Brock . | |
| 147,797 | * | 2/1874 | Schwab . | |
| 251,883 | | 1/1882 | Holmes . | |
| 1,355,270 | | 10/1920 | Roberts . | |
| 1,446,253 | | 2/1923 | Hall . | |
| 1,465,884 | | 8/1923 | Vandervoort . | |
| 1,512,323 | * | 10/1924 | Wallace . | |
| 1,637,648 | | 8/1927 | Kopf . | |
| 2,140,827 | | 12/1938 | Boag . | |
| 2,200,472 | | 5/1940 | Erdmann . | |
| 2,328,568 | | 9/1943 | Maxwell . | |
| 2,351,351 | * | 6/1944 | Maxwell et al. . | |
| 3,441,131 | * | 4/1969 | Gebauer | 209/139.1 |
| 3,695,165 | | 10/1972 | Sienkiewicz et al. . | |
| 3,809,438 | * | 5/1974 | Hubbard | 302/22 |
| 3,941,687 | | 3/1976 | Peterson . | |
| 4,122,208 | * | 10/1978 | Tronstad | 426/641 |
| 4,568,453 | | 2/1986 | Lowe, Jr. . | |
| 4,678,560 | | 7/1987 | Stole et al. . | |
| 4,737,269 | | 4/1988 | Bischoff . | |
| 4,789,476 | | 12/1988 | Schulz . | |
| 4,800,810 | | 1/1989 | Masumoto . | |
| 4,865,721 | * | 9/1989 | Smith et al. | 209/135 |
| 5,019,242 | | 5/1991 | Donelson . | |
| 5,174,455 | | 12/1992 | Zelazny et al. . | |
| 5,403,235 | | 4/1995 | Baumgarten et al. . | |
| 5,409,118 | | 4/1995 | Bielagus et al. . | |
| 5,411,142 | | 5/1995 | Abbott et al. . | |

* cited by examiner

*Primary Examiner*—Donald P. Walsh
*Assistant Examiner*—Joseph C Rodriguez
(74) *Attorney, Agent, or Firm*—Malcolm B. Wittenberg

(57) ABSTRACT

A device and method for its use for separating particulate matter into fractional components. The device is characterized as being in the shape of a substantially vertical column having a feed port for feeding the particulate matter thereto. A top is provided for removing a light fraction of the particulate matter and a bottom for collecting a heavy fraction of the particulate matter and a longitudinal axis between the top and bottom portions of the column. Provision is made for drawing current of fluid such as air through the column which contains a channel characterized as having a series of angular bends with respect to the longitudinal axis, the bends being more acute to the longitudinal axis as the distance increases from the feed port.

19 Claims, 1 Drawing Sheet

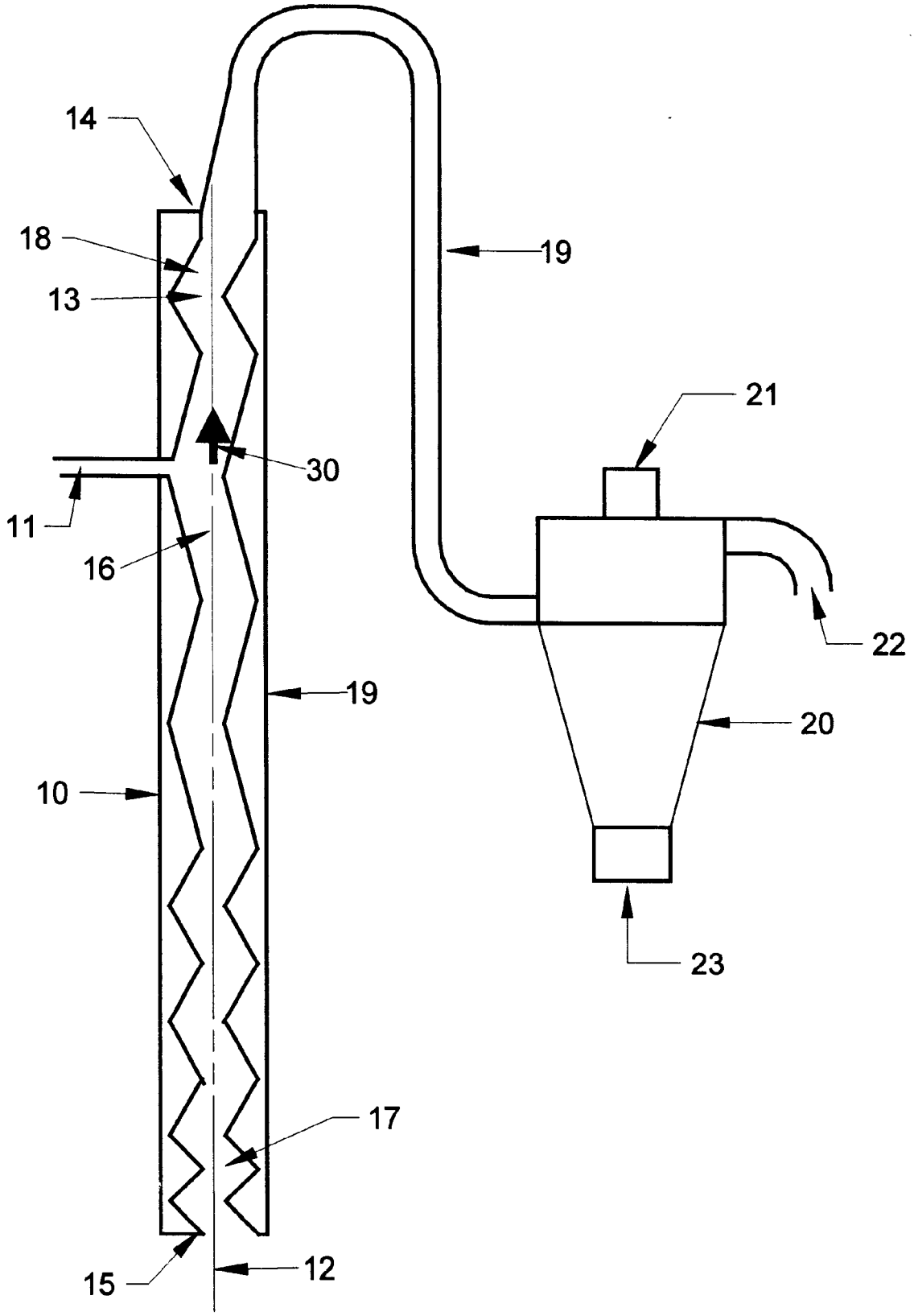
14
18
13
19
21
30
11
16
22
19
20
10
23
17
15
12

SEPARATION DEVICE AND METHOD OF USE

TECHNICAL DESCRIPTION OF THE INVENTION

The present invention is directed to a device and method for using it in the separation of particulate matter having physical characteristics enabling fractional components of the particulate matter to be separated by subjecting them to various fluid velocities. The device includes a feed port and channel having a specific geometry for optimizing the separation of fractional components therein.

BACKGROUND OF THE INVENTION

The use of fluid flow under positive pressure or vacuum as an expedient for the separation of particulate matter into various fractional components is well known. Devices of this nature generally known as air classification have taken advantage of differences in density, particle size and particle surface smoothness to fractionate a mass of particulate matter in a wide variety of fields.

In the field of air classification, a critical aspect of achieving sufficient particle separation to achieve effective separation is a minor limiting factor. For example, oftentimes the physical characteristics of a particular mass of feed material to be separated has a composition where the attractive force between particles results in clumps of such particles being subject to the separation process. Separating feed of this nature requires different considerations than the separation of dry highly mobile particles. This is particularly the case when animal matter such as dried fish meal is to be separated into its meat component and scale and bone components. Also, harvested seeds which could include stems, leaves, soil and other foreign debris requiring separation can have a high moisture content depending upon the climactic conditions existing at the time of harvesting. None of the separators employing fluid flow traveling through a column accounts for clumping and other physical characteristics which may characterize the particulate feed matter made subject to the separation process.

It is thus an object of the present invention to provide a device for separating particulate matter into fractional components which is uniquely adapted to maximize particulate separation regardless of the moisture content and other physical characteristics of such matter.

SUMMARY OF THE INVENTION

The present invention is directed to a device for separating particulate matter into fractional components. The fractional components are characterized as having distinguishable physical characteristics enabling them to be separated by subjecting them to varying fluid velocities.

The device of the present invention comprises a substantially vertical column, a feed port for feeding particulate matter thereto, a top for removing a light fraction of the particulate matter and a bottom for collecting a heavy fraction of the particulate matter. The column has a longitudinal axis between the top and bottom together with means for drawing a current of fluid through the column. A channel is configured within the column, the channel being characterized as having a series of angular bends with respect to the longitudinal axis. The bends contained within the channel are more acute to the longitudinal axis as the distance increases from the feed port.

BRIEF DESCRIPTION OF THE DRAWINGS

The sole FIGURE appended to the written description is a side plan view of this invention in partial cross-section.

DETAILED DESCRIPTION OF THE INVENTION

As noted previously, the present invention is directed to device 10 for separating particulate matter into fractional components. Although the nature of the particulate matter will be more thoroughly discussed hereinafter, generally, the particulate matter should broadly be composed of fractional components having distinguishable physical characteristics enabling them to be separated by subjecting them to varying fluid velocities.

Column 19 is generally oriented vertically and is ideally in the form of a column having a substantially rectangular cross-section.

The device of the present invention is provided with feed port 11 for feeding particulate matter within column 19. As noted in the appended FIGURE, feed port 11 ideally is configured to introduce particulate matter closer to top 14 than bottom 15 of column 19. The reason for this geometry is that upon introduction of particulate matter within column 19, a fluid such as air flowing in the direction of arrow 30 will cause some of the light, less dense material through channel 13 and out of tubing 19 leaving the enriched coarser, heavier fraction of the feed material in the column which tends to precipitously drop below the feed point. The coarser fraction generally requires more column length to promote separation as the separating process continues.

Again, as noted in reference to the appended figure, channel 13 is provided with a series of angular bends with respect to longitudinal axis 12 which vary in profile. In the section proximate entry port 11, these bends tend to be flatter in area 16 while as one progresses above and below feed port 11 along longitudinal axis 12, these bends tend to become more acute. In fact, the side walls of channel 13 in the area of feed port 11 can be substantially parallel to longitudinal axis 12 while the side walls in areas 18 and 17 proximate the top and bottom of the column, respectively, can be approximately 45° to longitudinal axis 12 resulting in 90° elbow bends as the column is viewed in cross-section.

The angular bends within channel 13 have been configured to maximize particle separation. Specifically, the channel angles are arranged so that particulate matter entering feed 11 would initially impact upon obtuse angular side walls maximizing initial separation if clumping as a result of high moisture content or otherwise is a characteristic of the feed material. As noted previously, in this section, some light feed material is drawn through top area 13 of the separator leaving an enriched coarser fraction to fall below feed port 11. As more of the "fines" are removed, particulate matter enters area 17 where the acute angular profile of the channel causes a pulsating effect. As the areas measured from apex to apex and side wall to side wall change air velocities vary within the channel noting that the multiple of area and horizontal air velocity remains constant. This pulsating effect serves to separate the particles within the channel and results in a more efficient product separation.

As separation continues within column 19, less dense particulate matter is caused to travel in the direction of air flow, that is, in the direction of arrow 30 caused by a vacuum being drawn upon column 19 by motor 21. This separated particulate matter is then caused to travel through output conduit 19 and into a separator. Product can be collected through the use of a filter or any other expedient as separation subsequent to involvement by column 19 is not necessarily the crux of the present invention. However, as a preferred embodiment, cyclone separator 20 can be provided whereby separated particulate matter traveling through conduit 19 can be caused to be further collected by drawing such a matter through outlet port 22 allowing further more dense components to be withdrawn from port 23 for possible recycling through column 19 (not shown).

Although a number of column channel dimensions can be selected in conjunction with appropriate air flows depending upon the nature of the particulate matter to be separated, it is generally believed that a column having a rectangular cross-section whereby the channel is provided with a width dimension of 12 inches and depth of 24 inches is ideal. If cross-sectional areas become greater than those recited, imbalances and inconsistencies in fluid flow can be set up at any given point within channel 13 reducing separation efficiency. Further, a vacuum created by motor 21 should ideally be created resulting in an a fluid flow in the direction of arrow 30 at a rate between approximately 6 to 15 meters per second. In each instance, one can match air flow and channel cross-sectional area to create the desired turbulence at various fractionation points.

As noted previously, the present invention can be employed to separate a wide variety of particulate matter. For example, fish meal and dried meal produced from other animal sources can be separated from bone and scale fragments as well as a variety of extraneous materials. Employing fish meal as an example, this particulate matter enters column 19 through feed port 11 where it meets the up drafting fluid stream traveling in the direction of arrow 30. An initial separation of heavy and light particles takes place in region 16. However, due to cohesion, product lumping and other factors, some of the light particles will proceed downward within the channel to area 17. The rather flatness of the side walls in region 16 will aid in initial separation and the breakdown of clumped particles for further processing. In area 17, where the side walls are configured to be 45° to longitudinal axis 12, different cross-sectional areas cause the channel velocity to increase from v to 1.4 v. This changing velocity pattern facilitates a breakup of product lumps and enhances separation between particles increasing the separation efficiency of the apparatus.

In dealing with fish products, the present invention effectively separates fish meat from scale and bone fraction (ash) in dried fish powder (fish meal). The invention takes advantage of the differences in particle density, shape, surface characteristics and moisture content of the fish meal on the one hand and bone and scale on the other to effect appropriate separation. The ash content collected in the vicinity of bottom 15 is to exceed 20% and preferably 30% or higher. The ash fraction is to be practically free of muscle meat. Such a fraction is suited for extraction of gelatin or other constituents contained in fish bones and scales. Alternatively, this fraction that can be further processed by hydrolysis to increase digestibility which is clearly a post-invention consideration as the invention further contemplates recycling product back through feed 11 either from conduit 23 or bottom 15.

The present invention can also be employed as a seed cleaning expedient by enhancing the removal of extraneous material such as stems and leaves from the seeds themselves. It is quite apparent that the moisture content, clumping propensity, density and surface characteristics between seeds, leaves and stems makes the present invention ideally suited to perform this cleaning function. In addition, it is noted that seeds of low and high germination rates and those which are hybrid and non-hybrid varieties are of different densities and oftentimes display varying surface characteristics which again makes the present invention ideally suited to perform separation. As such, through the use of this device, the germination rates of seeds can be enhanced and hybrid and non-hybrid seeds separated.

A further use of the present invention is to classify crystalline products such as sugar and salt in order to increase the classification of such crystalline materials by particle size. In applying, for example, sugar particles to confectionery products, it is important that the sugar particles be of a substantially uniform size or dimension. The present invention can increase the concentration of uniformly consistent crystalline material for this purpose noting that such crystalline materials when subjected to turbulent fluid velocities tend to separate.

A yet further use of the present invention is in dust removal in size classification in the production of spices such as onion and garlic powders. In addition to dust removal, products such as onion salt and garlic salt require that the onion and garlic particles be of substantially the same density as the salt incorporated therewith. Unless uniformity is achieved, during the shipment and settlement of the product, all of the salt would tend to segregate from the onion or garlic powder resulting in an unacceptable product. Through the practice of the present invention, uniform density and size are achieved for further spice preparation and packaging.

While particular embodiments of the invention have been shown and described, it will be obvious to those skilled in the art that changes and modifications may be made without departing from the invention in its broader aspects, and therefore, the aim and the appended claims is to cover all such changes and modifications as fall within the true spirit and scope of the invention.

What is claimed is:

1. A device for separating particulate matter into fractional components, said fractional components having distinguishable physical characteristics enabling said fractional components to be separated by subjecting them to varying fluid velocities, said device comprising a substantially vertical column, a feed port for feeding particulate matter thereto, a top for removing a light fraction of said particulate matter and a bottom for collecting a heavy fraction of said particulate matter and a longitudinal axis between said top and bottom, means for drawing a current of fluid through said column, and a channel configured within said column, said channel being characterized as a series of angular bends with respect to said longitudinal axis, said bends being more acute to said longitudinal axis as the distance increases from said feed port.

2. The device of claim 1 wherein said means for drawing a current of fluid through said column comprises a vacuum means appended proximate the top of said column.

3. The device of claim 1 wherein fluid emanating the top of said column is fed to a collector.

4. The device of claim 3 wherein said collector comprises a cyclone collector.

5. The device of claim 1 wherein said feed port is located closer to the top of said column than to the bottom of said column.

6. The device of claim 1 wherein said channel proximate said feed port is characterized as having side walls approximately parallel to said longitudinal axis.

7. The devise of claim 6 wherein said channel is characterized as having side walls approximately at 45° angles to said longitudinal axis proximate said bottom.

8. The device of claim 6 wherein said channel is characterized as having side walls approximately at 45° angles to said longitudinal axis proximate said top.

9. The device of claim 1 wherein said channel is rectangular in cross-section.

10. The device of claim 9 wherein said channel is up to approximately 12 inches in width and up to approximately 24 inches in depth.

11. The device of claim 1 wherein said current of fluid is drawn through said channel at a rate of approximately 6 to 15 meters per second.

12. A method of separating particulate matter into fractional components, said fractional components having distinguishable physical characteristics enabling said fractional components to be separated by subjecting them to varying fluid velocities, said method comprises feeding said particulate matter through a feed port and into a channel configured within a substantially vertical column, said column having a top, a bottom and a longitudinal axis between said top and bottom, and further being characterized as having a series of angular bends with respect to said longitudinal axis, said bends being more acute to said longitudinal axis as the distance increases from said feed port, drawing a current of fluid flow through said channel and collecting a light fraction of said particulate matter from the top of said column and a heavy fraction of said particulate matter from the bottom of said column.

13. The method of claim 12 wherein said drawing a current of fluid flow through said column comprises pulling a vacuum from the top of said column.

14. The method of claim 12 wherein said light fraction is fed to a collector after emanating from the top of said column.

15. The method of claim 14 wherein said collector comprises a cyclone collector.

16. The method of claim 12 wherein said particulate matter comprises fish matter wherein fish meat is collected at the top of said column and fish bone and scales are collected at the bottom of said column.

17. The method of claim 12 wherein said particulate matter comprises seeds, seed stems and leaves.

18. The method of claim 12 wherein said particulate matter comprises seeds having varying germination characteristics.

19. The method of claim 12 wherein said particulate matter comprises members selected from the group consisting of garlic, onion, salt, sugar and mixtures thereof.

* * * * *